United States Patent [19]

Hopmann

[11] Patent Number: 4,928,772

[45] Date of Patent: May 29, 1990

[54] METHOD AND APPARATUS FOR SHIFTING A PORTED MEMBER USING CONTINUOUS TUBING

[75] Inventor: Mark E. Hopmann, Broken Arrow, Okla.

[73] Assignee: Baker Hughes Incorporated, Houston, Tex.

[21] Appl. No.: 308,875

[22] Filed: Feb. 9, 1989

[51] Int. Cl.[5] ..... E21B 34/06

[52] U.S. Cl. ..... 166/386; 166/332

[58] Field of Search ..... 166/385, 386, 73, 332, 166/334

[56] References Cited

U.S. PATENT DOCUMENTS

| | | | |
|---|---|---|---|
| 3,089,546 | 5/1963 | Cochran | 166/332 |
| 3,273,649 | 9/1966 | Tamplen | 166/332 |
| 3,768,562 | 10/1973 | Baker | 166/332 X |
| 4,124,070 | 11/1978 | King et al. | 166/385 X |
| 4,431,058 | 2/1984 | Spencer et al. | 166/332 X |
| 4,520,870 | 6/1985 | Pringle | 166/332 X |
| 4,685,516 | 8/1987 | Smith et al. | 166/385 X |

*Primary Examiner*—William P. Neuder

*Attorney, Agent, or Firm*—Hubbard, Thurman, Turner & Tucker

[57] ABSTRACT

A method and apparatus are provided for introduction into a subterranean well on a continuous length of remedial tubing which is concentrically insertable through production tubing previously positioned within the well, the production tubing carrying at least one ported member for selective transmission of fluid between the exterior and the interior thereof, with each of the ported members receiving means which are movable in each of opening and closing directions for opening and closing the respective ported member. The apparatus comprises a cylindrical tubular housing having a fluid passageway therethrough communicable with the interior of the remedial tubing for transmission of fluid from within the remedial tubing, through the apparatus, and within an auxiliary apparatus carryable within said well by said remedial tubing, and positionable in said well in proximity to one of said ported members. The apparatus also comprises means selectively co-engagable with the opening and closing means for moving the opening and closing means in only one of opening and closing directions.

10 Claims, 3 Drawing Sheets

METHOD AND APPARATUS FOR SHIFTING A PORTED MEMBER USING CONTINUOUS TUBING

BACKGROUND OF THE INVENTION

1. Field of the Invention

The invention relates to a method and apparatus for introduction into a subterranean well on continuous remedial tubing for activating a ported member, such as a sliding sleeve, positioned on another conduit, such as production tubing. The invention also contemplates a sleeve which is activatable by a remedial continuous tubing-carried device.

2. Description of the Prior Art

In the past, those skilled in the art relating to remedial operations associated with the drilling, production and completion of subterranean oil and gas wells have relied on conventional "snubbing" or hydraulic workover units which utilize threaded or coupled remedial tubing normally inserted through production tubing for use in operations, such as perforating, acidizing and fracturing, corrosion control, pressure testing of tubular goods and vessels, cementing, clean out operations, sand bridge removal, storm valve recovery, insertion of kill strings, wireline tool fishing, and the like.

Continuous coiled remedial tubing and injectors for use therewith have contributed substantially to conventional remedial tubing operations. For example, coil tubing, being continuous, can be inserted into the well faster than threaded and coupled tubing which is furnished in relatively short sections that must be screwed together. In addition, it is easier, when required, to pass continuous tubing through stuffing boxes and blowout preventers because its external diameter is consistently the same size and not interrupted periodically by couplings. The coiled remedial tubing normally is made of steel and is commercially available in sizes from 0.75 inch o.d. through 1.315 inch o.d., but may have a smaller or larger diameter. Typical of such remedial coil tubing and injectors is that generally described in U.S. Pat. No. 3,182,877. The apparatus is commercially referred to as the "Bowen Continuous Spring Tubing Injector Unit" and basically comprises a hydraulically powered injector unit which feeds a continuous remedial tubing string from a coiled or "spooled" workstring contained on a powered and generally portable reel unit into the wellhead by means of two opposed, endless, rotating traction members. Such a reel unit is generally described in U.S. Pat. No. 3,614,019. The upper end of the string which remains on the reel is conventionally connected to the hollow shaft of the reel which permits a liquid or a gas to be pumped through the coiled remedial tubing string by means of a swivel connection. The injector and reel are normally mounted on a single transportable skid, a trailer, or, alternatively, may be componently arranged on skids to facilitate convenient offshore use.

To inject remedial coiled tubing, the injector is arranged on or above the wellhead. The reel unit, containing up to approximately 15,000 feet of continuous coiled metal remedial tubing, is located preferably about 15 to 20 feet from the wellhead. The remedial coiled tubing is brought from the reel in a smooth arc loop through the injector unit and into the well through pressure retention and control equipment.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation. Most production formations have a substantial horizontal portions and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be redrilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally liner wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In such deviated wellbores, particularly those having the longer lengths, it is difficult, if not impossible, to activate completion equipment, such as shifting tools for opening and closing sleeves, activating wash tools, and the like, by means of conventional electric or piano wireline means, which are disposed through the production tubing which, in turn, has been implaced within the well section through casing (assuming that the well is encased), or, alternatively, through open hole (if the well is not so encased). As the well section becomes more deviated, the weight suspended from the wireline will become insufficient to actuate the tool, or, at least, to properly position it at the desired location within the deviated portion of the well. Such tools can thus be expected to become improperly lodged or unpositionablle within such well. Accordingly, remedial continuous coiled tubing can be utilized to perform operations in such wells heretofore practiced by application of wireline actuated devices. During acidizing, fracturing, or other completion operations wherein it is desirable to circulate a treating fluid for contact with the production zone, or other areas within the well, it has been known to provide a length of such production tubing with a ported member which has a series of radially extending ports provided within the housing which are selectively closed to prevent fluid flow between the interior and the exterior by means of what is commonly referred to as a "sliding sleeve", which is a member which is implaced within the interior of the device in proximity to the ports, and which is shifted by means of an auxiliary device between open and closed positions. At such time as it is desirable to inject the treating or other fluid into the annulus between the production tubing and the casing (or the open well, in the case of uncased wells), the sleeve is shifted to open the ports for fluid communication between the interior of the production tubing the exterior, or annular area, as defined. Sometimes, such sliding sleeve is manipulated by a device which is carried into the well on wireline, such as electric or piano wire. However, in instances in which such sliding sleeve is positioned within a substantially horizontal section of a subterranean well during the horizontal completion of the well, it will become difficult, if not impossible, to manipulate the sleeve by such means, because the shifting means will either become stuck in the well prior to coming into proximity with the sleeve, or, if properly located, cannot be activated where the shifting device requires application of set down weight to shift the sleeve in a direction to move it to an opening or closing position. The present invention overcomes such deficiencies by providing a device which is carryable into the well upon continuous remedial tubing, described above.

SUMMARY OF THE INVENTION

The present invention provides an apparatus for introduction into a subterranean well on a continuous length of remedial tubing concentrically insertable through production tubing previously positioned within the well. The production tubing carries at least one ported member for selective transmission of fluids between the exterior and the interior of the production tubing. Each of the ported members receives means movable in each of opening and closing directions for opening and closing a respective ported member.

The apparatus comprises a cylindrical tubular housing having a fluid passageway which is communicable with the interior of the remedial tubing for transmission of fluid from within the remedial tubing, through the apparatus, and within an auxiliary apparatus which is carryable within the well by the remedial tubing and positionable in the well in proximity to one of the ported members. Means are provided which are selectively co-engagable with the opening and closing means for moving the opening and closing means in only one of opening and closing directions.

DESCRIPTION OF THE PREFERRED EMBODIMENTS

Figure 1:
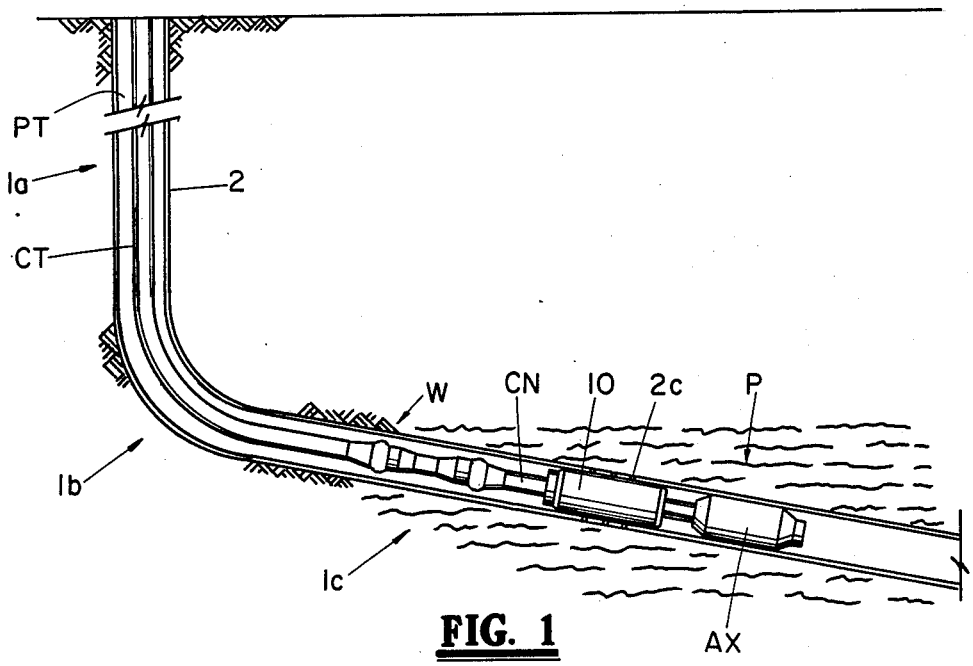
FIG. 1 is a schematic sectional illustration of a horizontal completion of a subterranean well with the device of the presention invention inserted through production tubing and carried on remedial tubing.
Figure 6:
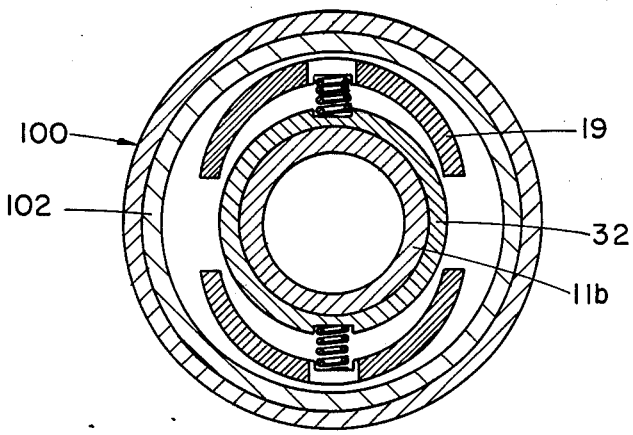
FIG. 6 is a cross-sectional view taken along line 2—2 of FIG. 2.

Now with reference to FIG. 1, there is shown a deviated wellbore W of the type for which this invention is particularly useful. Such wellbore W comprises a vertical entry section 1*a* communicating through a reltively short radius curvature portion 1*b* with a non-vertical or horizontal portion 1*c* communicating with a production formation P. In most instances, the production formation P extends for a substantial horizontal extent and the generally linear wellbore portion 1*c* traverses a substantial horizontal extent of the production formation, at least up to a distance of 1000 to 2000 feet or more. The radius portion 1*b* of the wellbore W has a curvature of at least 10° per 100 feet of length and preferably a curvature lying the range of 10° to 30° per 100 feet of length. While not limited thereto, each of the modifications of this invention will be described in connection with a casing 2 having been previously inserted in the wellbore and perforated as shown at 2*c*, although this is not necessary, particularly in the curved portions 1*b* and the linear non-vertical or horizontal portions 1*c* traversing the production formation P.

The embodiments of this invention may also be utilized in the well which has not been encased, and which is therefore considered to be an "open hole" completion.

As shown in FIG. 1, the production tubing PT is implaced within the casing C and coiled tubing CT has been inserted from the top of the well carrying an apparatus 10 of the present invention which is affixed to the coiled tubing CT by connector CN, the connector CN being shown and described in U.S. Application Ser. No. 308887, entitled "METHOD AND APPARATUS FOR SECURING AND RELEASING CONTINUOUS TUBING IN A SUBTERRANEAN WELL, and filed on the same date as this application, the assignee of said application being the same as the present application.

An auxiliary tool AX, which may be a wash tool, or other known device, is carried on the coiled tubing CT into the well W and positioned somewhat below the apparatus 10.

Figure 2:
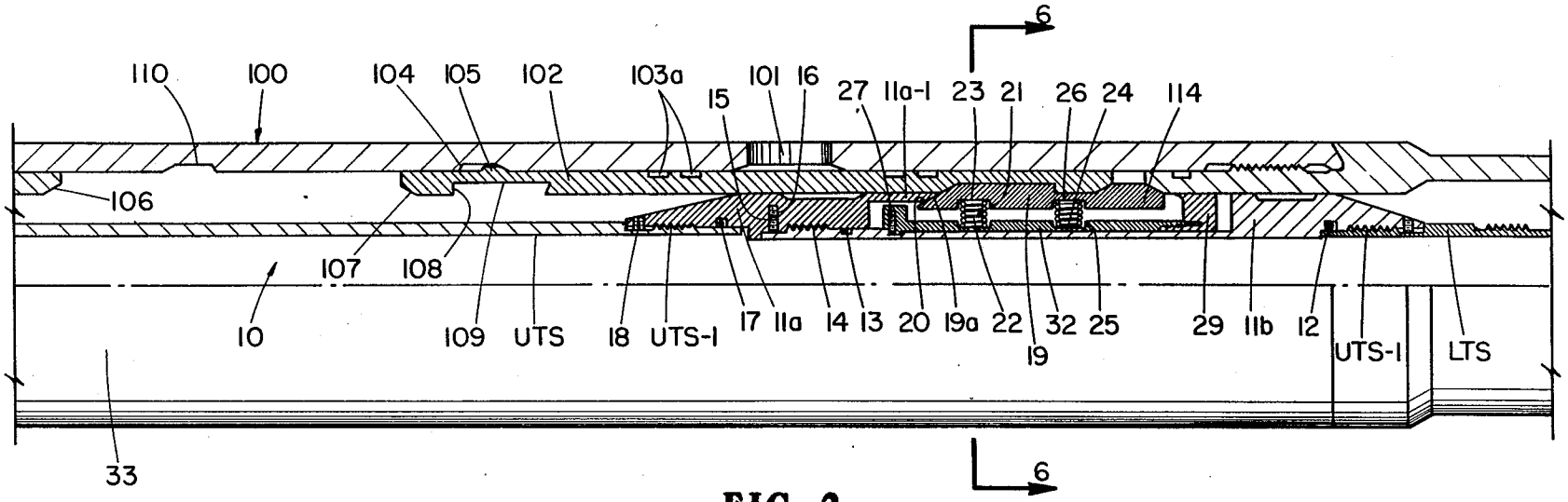
FIG. 2 is a longitudinal sectional drawing showing the apparatus carried into the well on remedial continuous tubing and in position subsequent to being activated to close the ported member.

As shown in FIG. 2 theapparatus 10 is affixed by means of threads UTS-1 on tubing section UTS which is secured to the lowermost end of a connector, or other device, carried into the well on the coiled tubing CT. The apparatus 10 is comprised of first housing member 11*a* and a second housing member 11*b*. The first housing 11*a* has at least one end threads UTS-1 for securement of the housing 11*a* to the tubing section UTS. A series of set screws 18 may be implaced through the housing 11*a* to become affixed circumferentially around a smooth surface on the tubing section UTS for further securement between the section UTS and the housing 11*a*. A circumferentially extending elastomeric O-ring seal element 17 is carried within a companion groove way within the housing 11*a* to prevent fluid communication between the housing 11*a* and the tubing section UTS.

The housing 11*a* extends longitudinally through the apparatus 10 and is secured to the housing 11*b* by means of threads 14, with a series of set screws 15 being implaced within a bore 16 through the housing 11*b* for further securement of the housing 11*a* relative to the housing member 11*b*. An O-ring seal element 13 is disposed around one circumferential end of the housing 11*a* to prevent fluid communication between that portion of the housing 11*a* and that portion of the housing 11*b* positioned exteriorly therearound. An O-ring seal element 12 also is provided around the interior of the housing 11*b* to prevent fluid communication between the housing 11*b* and a tubing section LTS, the section LTS being secured to the apparatus 10 by means of threads LTS-1.

Figure 3:
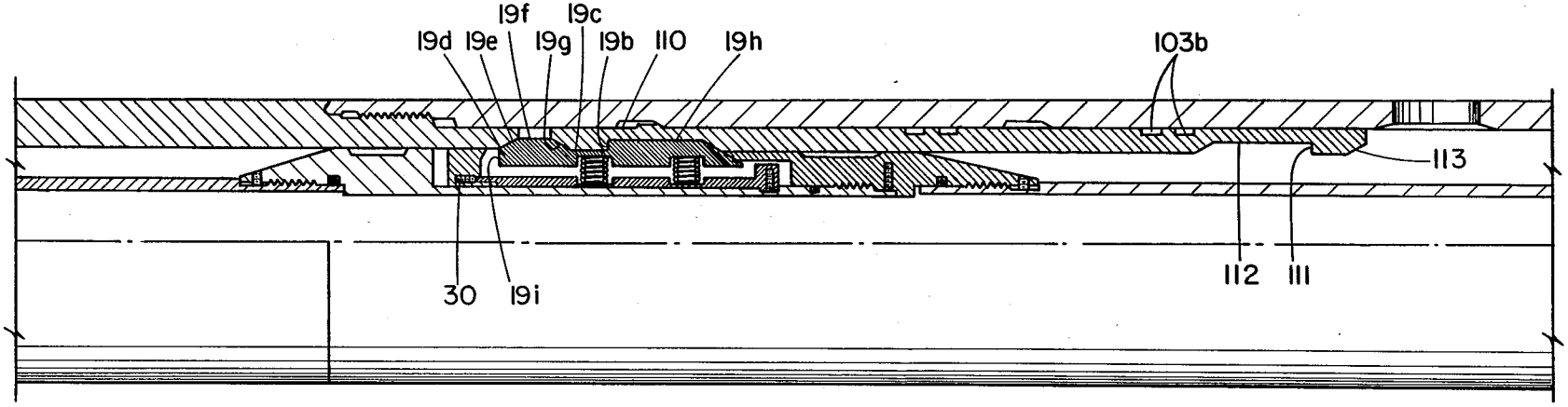
FIG. 3 is a view similar to that of FIG. 2, but showing the apparatus in position subsequent to moving the opening and closing means of the ported member in the opening direction.

Any auxiliary tool may be secured either directly to the apparatus 10 adjacent to the housing 11*b* at the threads LTS or, alternatively, a given length of tubing LTS may be secured thereto with another auxiliary tool secured at the opposite end of the section LTS. Such auxiliary tool may also be provided in an apparatus in another apparatus 10 used to manipulate the sleeve 102 of the ported member 100 to a position opposite that position effected by use of the apparatus 10, as shown in the drawing of FIG. 3.

The apparatus 10 is bored through the housing 11*a* and housing 11*b* to provide the fluid passageway 33 within its interior which communicates with the interior of the tubing section UTS, all the way to the top of the well by means of the coiled tubing, and which communicates with the companion fluid passageway interior of the lower tubing section LTS, which will extend down the length of the tool section formed therebelow, for passage of injection fluid, corrosion inhibitor, lost circulation material, or the like. Such fluid may be introduced through the flow port 101 of the ported member 100, without full retrieval of the apparatus 10 to the top of the well after shifting of the sleeve 102 to the open position, or such fluid may be transmitted lowerly through the well for introduction into the well at another location.

Along an exterior surface of the housing 11*b* is provided a spring mandrel 32 having spring housing bores 22 and 25 therein for receipt of spring elements 21 and 24, respectively, the outer end of each spring 21, 24 being received within spring housing bores 23 and 26, respectively, within the interior of a series of circumferentially extending profiled shifting keys 19.

Each of the keys 19 have a cone shaped end 19*a* the tip of which is received inwardly of a tapered end 20 of an sleeve portion 11*a*-1 of the housing 11*b*. Such interengagement of the cone shaped end 19*a* of the shifting keys 19 within the sleeve portion 11*b*, in combination with the outward urging force defined through the spring members 21, 24, maintain the shifting keys 19 in outwardly flexed position within the apparatus 10.

The spring mandrel 32 is secured along the housing 11*a* and retained in position therein by means of the set screws 27 at an end of the mandrel 32 and a circularly extending mandrel retainer 29 at the other end thereof which is affixed by means of a set screw 30 extending through the retainer 29 and to the top face of the mandrel 32. A key retainer 31 is snugly engaged around the face of the mandrel retainer 29 to retain the shifting keys 19 in place at their end within the apparatus 10.

Extending circumferentially around the shifting keys 19 at one end of the lower cone shaped portion 19*a* is the main body surface 19*h*. The main body surface 19*h* terminates in an inwardly extending 90° shoulder or surface 19*b*. It is this shoulder or surface 19*b* which is the primary shifting surface for manipulation of the sleeve 102. The shoulder or surface 19*b* communicates with a longitudinally extending straight surface portion 19*c* around the exterior of each of the shifting keys 19 which, in turn, terminates in an outwardly beveled surface 19*g* of a key member 19*d*. The key member 19*d* has an outermost longitudinal surface 19*f* thereon which itself terminates in an inwardly bushed shoulder 19*e*. Each of the shifting keys 19 has a top shoulder 19*i*.

The ported member 100 is carried on a section of the production tubing PT into the well and and has a hollow interior for receipt of the apparatus 10 therethrough. A flow port 101 is provided within the ported member 100 which, as shown in FIG. 2, is interiorly covered by means of the position of the sleeve 102. Fluid communication between the ported member 100 and the interior of the member 100 is prevented by upper and lower pairs of molded elastomer sealing members 103*a*, 103*b* which are circumferentially implaced within receptacles therefore around the exterior of the sleeve 102.

The sleeve 102 is shown in FIG. 2 in locked closed position by means of flexible locking dogs 105 which are engaged within the companion closing locking grooves 104 circumferentially bored around the interior of the ported member 100.

The sleeve 102 also has implaced at the upper end thereof a opening shifting profile 109 having an opening shifting recess 108 at the uppermost end thereof. A tapered shoulder 107 is provided at the uppermost tip end of the sleeve 102, which is used in the manipulation of the sleeve 102, as hereinafter described.

When the sleeve 102 is manipulated from its lowermost position in the ported member 100, with the flow port 101 closed, (FIG. 2) to its uppermost position in the ported member 100 (FIG. 3), the flexible lock dogs 105 will be received in the open locking groove 110 on the ported member 100, and the profile shoulder 106 will be utilized to urge the shifting keys out of engagement relative to the shifting profile 109.

For use during the manipulation of the sleeve 102 from the uppermost position in the ported member 100 to the lowermost position therein to close the flow port 101, a closing shifting profile 112 is provided at the lowermost end of the sleeve 102. Such profile terminates at its lowermost end with a companion closing shifting recess 111 configured as the opening recess 108 at the uppermost end of the sleeve 102, and a shoulder 113 is provided at the lowermost tip end of the sleeve 102. A shoulder 114 provided on the lowermost portion of the ported member 100 also serves as a guide to actuate the shifting keys 19, as hereinafter described.

OPERATION

As discussed earlier, to move the sleeve 102 from its uppermost position within the ported member 100 in which the port 101 is in fluid communication with the interior 33, to the port closing position, shown in FIG. 2, the apparatus 10 is run into the well on a continuous length of tubing and positioned thereon as in FIG. 1. The tubing is thus run into the well W until such time as the apparatus 10 comes into proximity with the ported member 100. The shoulder 114 will contact the shoulder 107 on the sleeve 102 and the keys 19 will be flexed inwardly and pass across the profile 109. As the coiled tubing CT is manipulated within the well W lowerly, the surface **19*b* of the key will contact and engage a companion shoulder in the sleeve 102 with the bushed shoulder 19*e* snugly engaged upon the upper surface of the key retainer 31 of the production tubing conduit. As the coiled tubing CT is moved downwardly, the interengagement between the keys 19 and the sleeve 102, as shown in FIG. 2, will cause the sleeve 102 to come out of the locking groove 110. The sleeve 102 will continue downwardly until the port 101 is closed and the O-rings 103*a* and 103*b* are positioned above and below, respectively, the port 101 to sealingly engage therebetween relative to the ported member 100. The downward travel of the sleeve 102 will terminate upon the locking dogs 105 being received within the closed locking groove 104. Continued downward movement of the coiled tubing CT will cause the upper shoulder 19*e* of the member 19*d* to flex across the member 31 to overcome the force of the springs 22 to permit the keys 19 to radially retract and come out of the groove therefor in the sleeve 102. The coiled tubing CT may be then manipulated further longitudinally downwardly within the production tubing PT for other purposes, or may be retrieved to the top of the well without affecting the locking and closing position of the sleeve 102 relative to the member 100**.

If it is desired to open the sleeve 102 from a position in which it initially closes the port 101, the sleeve 102 is reversed from the position shown in FIG. 2 to that shown in FIG. 3. That is, when the production tubing is run into the well, the sleeve 102 will be positioned across the port 101 to sealingly close same, but the sleeve 102 will be placed in reverse direction from the position shown in FIG. 2. Accordingly, the sleeve 102 will be positioned within the member 100, as shown in FIG. 3, and will be initially run within the member 100, but with the sleeve 102 in the down position, closing the port 101. As the coiled tubing CT is run into the well, the shifting key 19 will be urged by means of the springs 22 into companion engagement with the profiles on the sleeve 102, as shown in FIG. 3. The interengagement of the shifting keys 19 with the sleeve 102 will be detected at the top of the well because further downward movement of the apparatus will be resisted because of the interface of the profiles relative to the shifting keys 19 and the sleeve 102. Accordingly, the coiled tubing CT is picked up at the top of the well and longitudinally moved upwardly such that the sleeve 102 becomes disengaged from the closed locking shoulder 104 and moves upwardly with the coiled tubing and the apparatus 10 until such time as the member 105 locking dog comes into engagement with the opening lock recess 110. Further pull on the coiled tubing CT will cause the bevel **19*e* of the member keys 19 to come off of interengagement with the member 31 to overcome the bias of the springs 22, 24, to permit the dogs 19 to come out of their respective engagement within the grooves of the sleeve 102. When the sleeve 102 is moved from closed to open position, the device is as shown in FIG. 3**.

Figure 4:
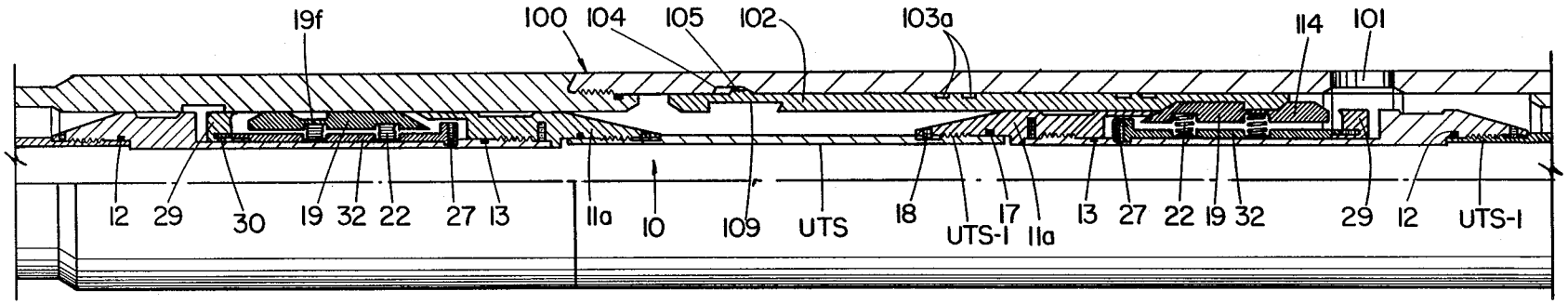
FIG. 4 is a view similar to those of FIGS. 2 and 3, showing the apparatus in an embodiment whereby two elements are carried on the remedial tubing: one for moving the opening and closing means in the opening direction, and the other for moving the opening and closing means in the other direction, and in position to close the opening and closing means relative to the ported member.
Figure 5:
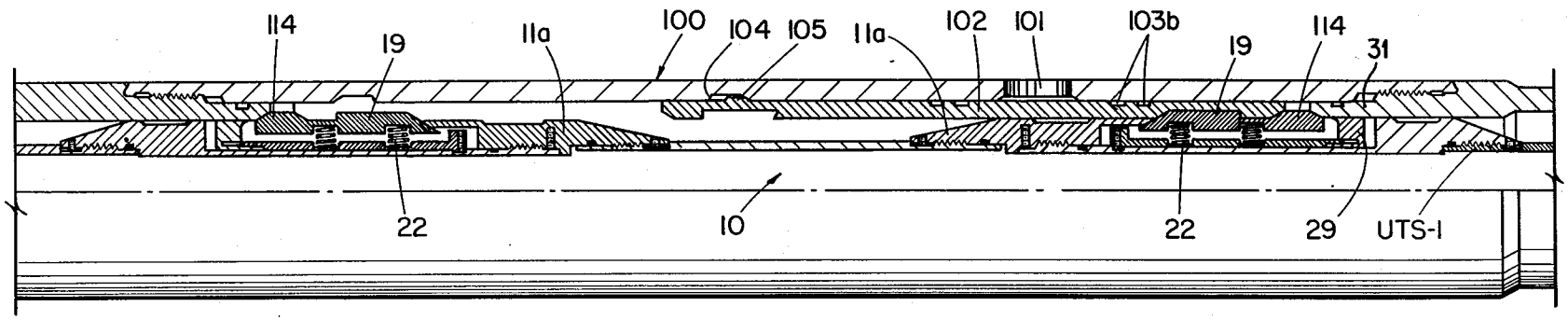
FIG. 5 is a view similar to that of FIG. 4, illustrating the opening and closing means being moved to the closed position.

Now referring to FIG. 4, there is shown a plurality of apparatuses 10 with a lower of the apparatus 10 in position to manipulate the sleeve member 102 from closed position to open position. The lower apparatus 10 is reversed from the position of the upper apparatus 10, such that the lower housing **11*b***, now becomes the upper housing, etc.

The apparatus 10 may be carried into the well either in the position as shown in FIG. 3 for manipulation of the sleeve 102 in one direction, or may be reversed and carried into the well for manipulation of the sleeve 102 in another direction. Additionally, a plurality of apparatuses 10 may be carried as a train on the coiled tubing CT into the well, one of the apparatuses 10 facing upwardly to manipulate the sleeve 102 in one direction and the other of the appartus 10 being placed for facing in another direction to move the sleeve 102 in the opposite direction, to either open or close the sleeve 102. In this fashion, the sleeve 102 may be either only open, only closed, or both open and closed in one trip into the well of the coiled tubing CT.

It will also be appreciated that the apparatus 10 is not selective: That is, it will either open and/or close, as provided, the first sleeve 102 which it encounters in a series of such sleeves which may be provided relative to a ported member 100 forming a part of the production tubing.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for introduction into a subterranean well on a continuous length of remedial tubing concentrically insertable through production tubing previously positioned within said well, said production tubing carrying thereon at least one ported member for selective transmission of fluids between the exterior and interior of the production tubing, each of said ported members receiving means movable in each of opening and closing directions for opening or closing the respective ported member, said apparatus comprising:

(1) a cylndrical tubular housing having a fluid passageway therethrough communicable with the interior of the remedial tubing for transmission of fluid from within the remedial tubing, through the apparatus, and within an auxiliary apparatus carryable within said well by said remedial tubing, and positionable in said well in proximity to one of said ported members; and (2) means selectively co-engageable with said opening and closing means for moving said opening and closing means in only one of opening and closing directions.

2. The apparatus of claim 1 wherein in said co-engagable means are activatable to move said opening and closing means in only one of opening and closing directions, by longitudinal manipulation of said remedial tubing.

3. The apparatus of claim 1 or claim 2 wherein said co-engagable means comprises a plurality of inwardly flexible key members circumferentially disposed exteriorly around said apparatus and normally urged outwardly of said apparatus.

4. Apparatus for introduction into a subterranean well on a continuous length of remedial tubing concentrically insertable through production tubing previously positioned within said well, said production tubing carrying thereon at least one ported member for selective transmission of fluids between the exterior and interior of said production tubing, each of said ported members receiving means movable in each of opening and closing directions for opening and closing the respective ported member, said apparatus comprising:

(1) a first cylindrical tubular housing having a fluid passageway therethrough communicable with the interior of the remedial tubing for transmission of fluid from within the remedial tubing, through the apparatus and within an auxiliary apparatus carryable within said well by said remedial tubing and positionable in said well in proximity to one of said ported members;

(2) first means selectively co-engagable with said opening and closing means for moving said opening and closing means in only one of opening and closing directions;

(3) a second cylindrical tubular housing having a fluid passageway therethrough communicable with the interior of the remedial tubing and the interior of the first cylindrical tubular housing for transmission of fluid from within the remedial tubing; and (4) second means selectively co-engagable with said opening and closing means for moving said opening and closing means is only the other of the opening and closing directions.

5. The apparatus of claim 4 wherein each of said first and second co-engagable means are activatable to move said opening and closing means by longitudinal manipulation of said remedial tubing.

6. The apparatus of claim 4 or claim 5 wherein each of said co-engagable means comprises a plurality of inwardly flexible key members circumferentially disposed exteriorly around said apparatus and normally urged outwardly of said apparatus.

7. Method for moving an opening and closing means in a subterranean well, comprising the steps of:

(1) introducing into said well an apparatus on a continuous length of remedial tubing concentrically insertable through production tubing previously positioned within said well, said production tubing carrying thereon at least one ported member for selective transmission of fluids between the exterior and the interior of said production tubing, each of said ported members receiving means movable in each of opening and closing directions for opening and closing the respective ported member, said apparatus comprising:

(a) cylndrical tubular housing having a fluid passageway therethrough communicable with the interior of the remedial tubing for transmission of fluid from within the remedial tubing, through the apparatus, and within an auxiliary apparatus carryable within said well by said remedial tubing and positionable in said well in proximity to one of said ported members; and (b) means selectively co-engagable with said opening and closing means for moving said opening and closing means in only one of opening and closing directions; and (2) longitudinally manipulating said remedial tubing whereby said co-engagable means move said opening and closing means in only one of opening and closing directions whereby, thereafter, fluid may be transmitted through said ported member between the exterior and interior of said production tubing.

8. Apparatus for introduction into a subterranean well, comprising:

(1) at least one ported member for selective transmission of fluids between the exterior and the interior of production tubing insertable into said subterranean well, each of said ported members receiving means movable in each of opening and closing direction for opening and closing the respective ported member; and (2) means for introduction into said well on a continuous length of remedial tubing concentrically insertable through said production tubing, said means comprising a cylindrical tubular housing having a fluid passageway therethrough comunicable with the interior of the remedial tubing for transmission of fluid from within the remedial tubing, through the apparatus, and within an auxiliary apparatus carryable within the well by said remedial tubing and positional in said well in proximity to one of said ported members, and second means selectively co-engagable with said opening and closing means for moving said opening and closing means in only one of opening and closing directions.

9. Apparatus for introduction into a subterranean well, comprising:

at least one ported member carrayable in said well on a tubular conduit introduceable into said well for selective transmission of fluids between the exterior and the interior of said tubular conduit, each of said ported members receiving means movable in each of said opening and closing directions for opening and closing the respective ported member, each of said means movable in each of opening and closing directions being manipulatable in one of said directions by a device having a cylindrical tubular housing carried by an auxiliary device introduceable into said well on a continuous length of remedial tubing introduceable through said conduit and having a cylindrical tubular housing having a fluid passageway therethrough communicable with the interior of said remedial tubing for transmission of fluid from within the remedial tubing, through the device, and within an auxiliary apparatus carryable within said well by said remedial tubing, and positionable in said well in proximity to one of said ported members, and means selectively engagable with said opening and closing means for moving said opening and closing means in only one of opening and closing directions.

10. A method of completing a wellbore having a deviated configuration including an entry portion communicating with a curved portion extending downwardly in the well from said entry portion and a generally linear end portion traversable with a production formation, comprising the steps of:

(1) introducing into said well through said entry portion through said deviated configuration to the generally linear end portion traversable with the production formation an apparatus on a continuous length of remedial tubing concentrically insertable through said production tubing previously positioned within said well through said deviated configuration and extending around the generally linear end portion and traversing said production formation, said production tubing carrying thereon at least one ported member for selective transmission of fluids from said production formation and from the exterior to the interior of said production tubing, each of said ported members receiving means movable in each of opening and closing directions for opening and closing the respective ported member, said apparatus comprising:

(a) cylindrical tubular housing having a fluid passageway therethrough communicable with the interior of the remedial tubing for transmission of fluid from within the remedial tubing through the apparatus and within an auxilliary apparatus carryable within said well by said remedial tubing and positionable in said well in proximity to one of said ported members; and (b) means selectively co-engagable with said opening and closing means for moving said opening and closing means in only one of opening and closing directions;

(2) longitudinally manipulating said remedial tubing through said entry portion, said deviated configuration and said generally linear end portion to traversing relationship with said production formation;

(3) longitudinally manipulating said remedial tubing whereby said co-engagable means move said opening and closing means in only one of opening and closing directions; and (4) transmitting fluid through said ported member between the exterior and interior of said production tubing from the top of the well, through the continuous remedial tubing and to the area immediate said production formation in said generally linear end portion.

* * * * *